United States Patent [19]

Osborn

[11] 4,085,822

[45] Apr. 25, 1978

[54] BAG ASSEMBLY AND METHOD AND APPARATUS FOR LOADING INDIVIDUAL BAGS

[75] Inventor: Paul V. Osborn, Webster, N.Y.

[73] Assignee: Mobil Oil Corporation, New York, N.Y.

[21] Appl. No.: 789,381

[22] Filed: Apr. 21, 1977

Related U.S. Application Data

[63] Continuation of Ser. No. 637,801, Dec. 4, 1975, abandoned.

[51] Int. Cl.[2] ..... E04H 3/04

[52] U.S. Cl. ..... 186/1 A; 53/385

[58] Field of Search ..... 186/1 A; 53/384, 385, 53/186, 187

[56] References Cited

U.S. PATENT DOCUMENTS

| | | | |
|---|---|---|---|
| 3,626,662 | 12/1971 | Graveley | 186/1 A |
| 3,678,652 | 7/1972 | Panasewicz | 53/385 |
| 3,858,382 | 1/1975 | Suominen | 53/385 |

*Primary Examiner*—Trygve M. Blix
*Assistant Examiner*—Reinhard J. Eisenzopf
*Attorney, Agent, or Firm*—Charles A. Huggett; James D. Tierney

[57] ABSTRACT

An assembly for thermoplastic shoppings bags which are adapted for employment as containers for grocery and produce items when they are employed in conjunction with a novel loading system for retail food market check-out counters. A novel method and apparatus are also provided for opening successive bags for filling and, when a bag is fully loaded, its removal from the filling station causes opening of an adjacent bag to a loading position.

1 Claim, 5 Drawing Figures

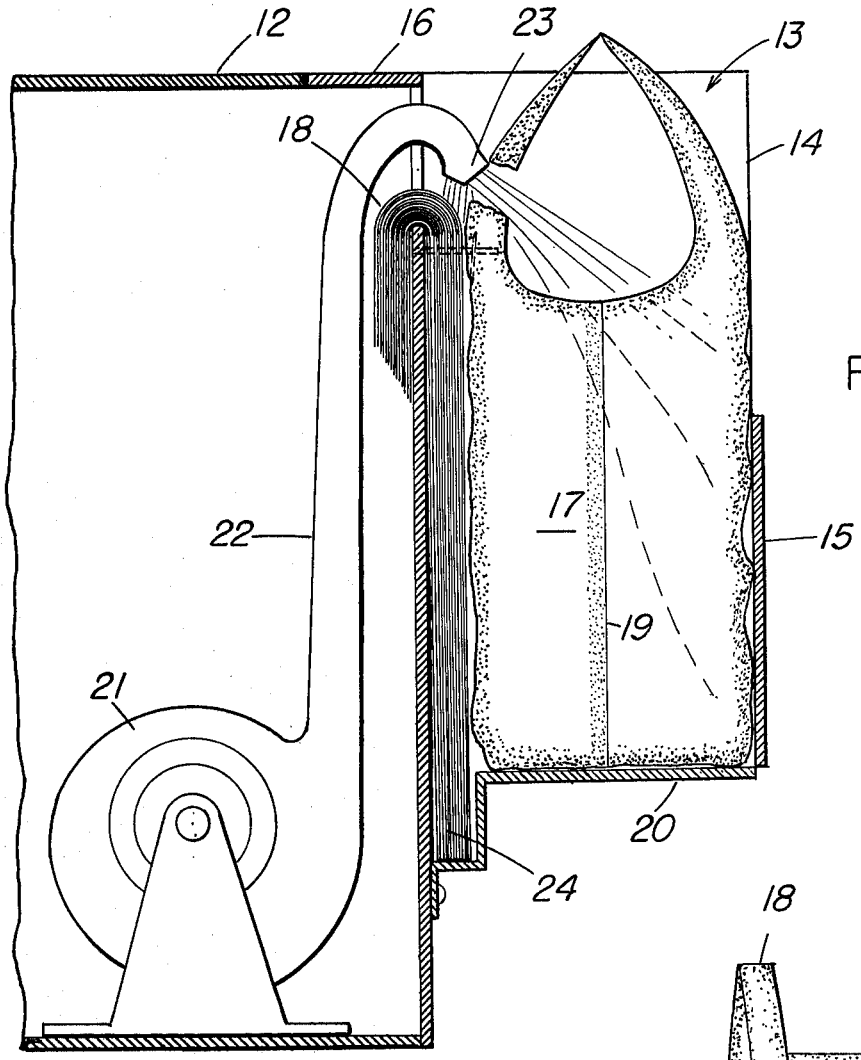
FIG. 2
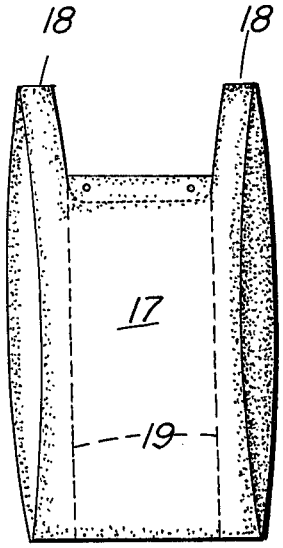
FIG. 5
FIG. 4
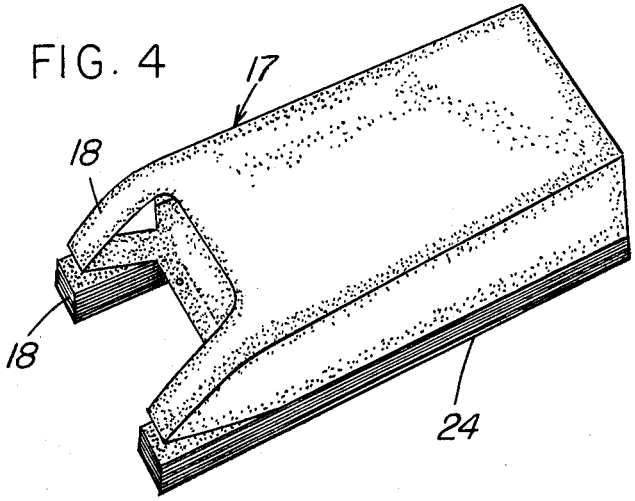

BAG ASSEMBLY AND METHOD AND APPARATUS FOR LOADING INDIVIDUAL BAGS

CROSS-REFERENCE TO RELATED APPLICATIONS

This application is a continuation application of U.S. Ser. No. 637,801, filed Dec. 4, 1975, now abandoned.

BACKGROUND OF THE INVENTION

1. Field of the Invention

The present invention relates to merchandise packaging systems and in particular to a system for packaging individual articles such as groceries in a handle-bearing thermoplastic bag at a grocery store check-out counter.

2. Brief Description of the Prior Art

In accordance with the prior art, for many years grocery stores have been using a system of bagging groceries at the check-out counters comprising loading individual paper bags. This system is inefficient, time-consuming, and expensive. A checker or packer must usually reach under the counter for a paper bag, open the bag by a quick motion of the arm causing air to catch in the bag and distend it, set the bag upright on the counter, and, in the case of double bagging operations, a second bag must be inserted inside the first bag to give additional strength. Finally, the groceries are placed into the bag and the filled bags are slid across the counter so that the customers can put their arms around the mid-portion of the bags and carry them out. In many instances the bottoms of such heavily laden paper bags tend to separate or tear because of the weakening effects of moisture absorption from products contained therein.

The general concept of packaging items in plastic bags has, in recent years, become well known in the art. However, such prior art attempts have for the most part met with a lack of success, particularly when employed in grocery market environments for grocery packaging at a check-out station. Due to the limp nature of the thin thermoplastic bags, it not only adversely effects the loading operation, but attempts to carry a loaded bag of groceries at the mid-portion of the bag for any distance prove awkward because of the limp film's tendency to allow the upper portion of the bag to fold over, spilling items from the bag.

Recent attempts to remedy the aforenoted deficiencies of plastic bags have included the provision of handles adjacent the bag mouth whereby grocery laden plastic bags could be transported as a shopping bag. However, the bag loading operation remained a problem with the difficulties attendant to loading a limp plastic bag which is incapable of self-support. Although semi-rigid plastic films are available such as vinyl, high density polyethylene and high modulus laminar structures formed therefrom, the cost of such material is far beyond the relative costs of paper packaging materials, making such structures economically unattractive.

SUMMARY OF THE INVENTION

An arrangement adapted to facilitate the employment and loading of a thermoplastic bag, with handles, at the check-out station of a retail grocery establishment which comprises at least one bag support enclosure positioned immediately adjacent to the check-out counter. A stack of thermoplastic bags with handles are vertically positioned and suspended against the rear wall of the support enclosure with the bag mouths uppermost and approximately adjacent the rear edge of the counter top. An air plenum directs a steady stream of air into the outermost bag in the stack causing the bag walls to distend to a fully open position. The walls of the enclosure assist in supporting and shaping the bag. The continuing stream of air maintains the bag in such an open position during the subsequent loading operation. When the bag has been loaded the bag handles are grasped and the loaded bag is removed from its enclosure for placing on the top of the check-out counter or any other disposition dependent upon the specific check-out system employed. Removal of the loaded bag allows for opening of the next bag in the stack by the constant stream of air from the plenum chamber so that it is instantly available for successive loading operations.

BRIEF DESCRIPTION OF THE DRAWINGS

FIG. 2 is a cross-sectional view taken on line 2—2 of 1.

FIG. 4 is a perspective view of a bag pack which may be employed in the practice of the present invention.

FIG. 5 is an individual bag which may be employed in the present system.

DESCRIPTION OF SPECIFIC EMBODIMENTS

Figure 1:
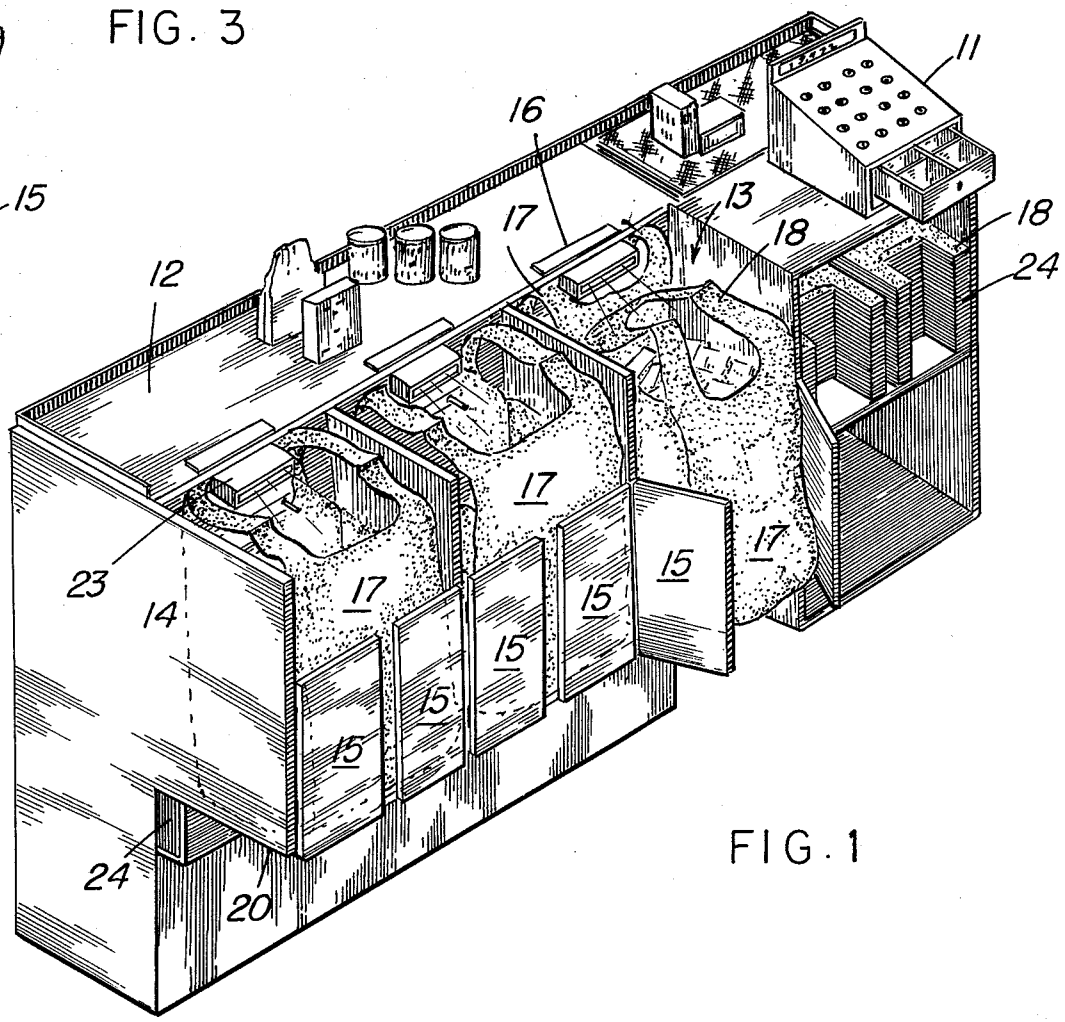
FIG. 1 is a schematic perspective view of a retail grocery market check-out arrangement in accordance with the present invention.

As shown in the accompanying drawings, and in particular FIG. 1, the packaging system of the present invention may be employed in conjunction with a retail grocery store check-out counter which may typically include a conventional cash register 11 or some other type of registering device which may be a component part of a computerized system for product identification and pricing computation. The grocery items are normally deposited upon counter-top 12 for itemization by the checker. As the price of each item is recorded by the checker on register 11 the item is deposited into bag 17 or alternatively the items may be placed in bag 17 after they have all been recorded on register 11 dependent upon the type of checking system peculiar to the individual store. As more particularly shown in FIG. 4, bag 17 comprises handle members 18 which are adjacent the opposite ends of the bag mouth. Such individual bag structures are described in U.S. Pat. No. 3,180,557, the disclosure of which is incorporated herein by reference. The bags are desirably gusseted as at 19 to increase the bags holding capacity while minimizing the storage and shipping space for such bags, as is conventionally practiced. Bag 17 may be desirably formed from a gusseted flattened tube of thermoplastic material such as polyethylene. The gusseted flattened tube is heat sealed and severed along lengths of the tube which correspond to the height of the bag. One heat sealed and severed end is cut out in a generally U-shaped configuration intermediate the gusseted areas 19 thereof forming an open bag mouth with handles 18 on opposite sides thereof. It will be noted that when such bags are loaded with grocery items, for example, the bag handles 18 may be grasped to provide a convenient carrying arrangement whereby the grocery sacks are now carried in the fashion of a shopping bag rather than as the conventional Kraft paper bag which was handless thereby necessitating grasping such a bag around its central portion. With a bag structure such as bag 17, multiple bags can be carried in each hand by the consumer. Further, since such bags are formed from thermoplastic, they are moisture proof and accordingly reduce substantially the incidence of bag breakage or leakage.

Figure 3:
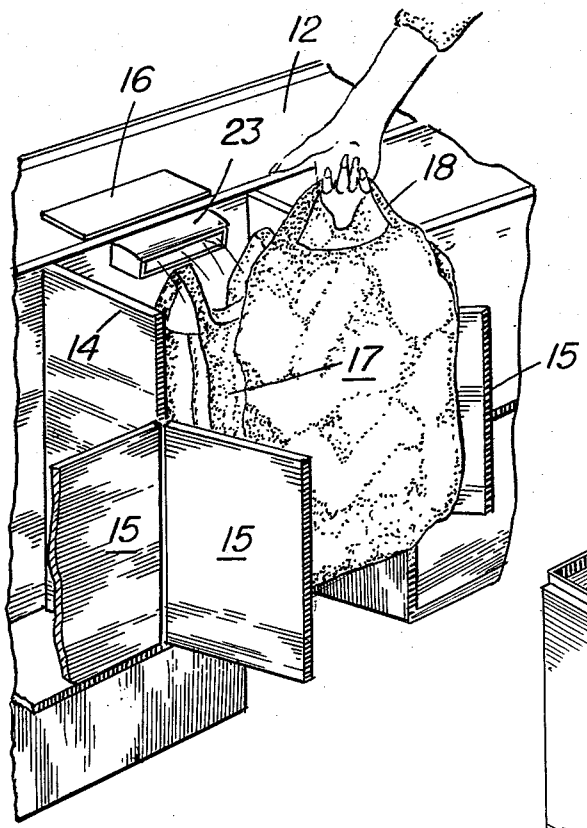
FIG. 3 is a fragmentary perspective view showing a loaded bag removal operation.

As more particularly shown in FIG. 3, the bag structures 17 when employed in the loading system of the present invention are assembled in packs of, for example, 50 or 100 bags. The bags are assembled utilizing conventional techniques such as for example staples or heat welding through an area 25 adjacent the bag mouth and within the confines of a perforated tab area 25 on the upper portion of the rear wall of the bag so that the bag front wall is free to move outwardly away from the rear wall. Such a package of bags may be suspended on the rear wall of individual bag loading stations 13.

Alternatively, for ease of manufacture and assembly of the bag packs, a perforated tab area 25 may be located on the upper portion of both the rear and front wall of the bags. When this latter arrangement is employed it obviously becomes necessary to manually initiate bag opening by tearing the bag front wall along the perforated line, to clear the front bag wall from its tab 25 and allow air to enter the bag mouth for complete opening.

When assemblying the bag packs of the present invention care must be taken to insure proper registry of the individual bags in the pack to allow an uninterrupted flow of air into the outermost bag in the pack for unimpeded opening thereof. Alternatively, a slight manual manipulation of the outermost bag wall to initiate air-opening thereof may be employed in the method of the present invention.

It has been found convenient to allow the bag handle portions 18 to assume a folded-back position rearwardly and depending downwardly of the bag stacks as shown in FIG. 2. As also shown in FIG. 2, each bag loading well 13 is provided with an air blower 21 which supplies air through plenum chamber 22, the air exiting at the air plenum outlet 23. In the system illustrated in FIGS. 1 and 2, each bag loading station 13 is provided with its own individual air blower 21. It will be understood however that a single air blower may be employed to service a plurality of bag loading stations 13 whereby a manifold device is employed to supply air from a single blower to a plurality of individual plenums.

As shown in FIGS. 1 and 2, as air is blown through plenum outlet 23 it strikes the front lip of bag 17 blowing it outwardly and at the same time filling the bag to distend it to a fully opened position. The rear wall of the bag is held in a close proximity to the bag pack 24 by virtue of the perforated tab 25 which remains fastened to the bag pack 24. The bag is partially shaped and supported by bottom support member 20 and bag supporting guides 14. The continued flow of air from outlet plenum 23 insures that the bag will remain in an erect and opened condition during the bag loading operation by the checker. After the bag has been completely loaded, the handles 18 are grasped and the bag is moved horizontally out of the bag loading station 13. This movement will rupture perforated tab 25 thereby allowing the rear bag of the wall to become detached from the bag pack 24 during this movement. This detachment of the bag rear wall also exposes the front lip of the succeeding bag whereby the air stream from outlet 23 now acts to open this bag for loading operation. As shown in FIG. 1, the bag loading stations 13 may be provided at their exit portal with a swinging door arrangement 15 for ease of bag removal along a substantially horizontal plane. As also shown in FIG. 1, access panels 16 are provided at each bag loading station 13. These access panels 16 are flush with the surface of counter-top 12 and are employed to allow ease of access to blower system 21. They may be either spring loaded or hinged to the counter-top surface. As shown in FIG. 2, the bottom of bag stack 24 extends below the bottom support 20 of bag loading station 13. Such an arrangement insures that, since the bag 17 is being inflated the bag bottom will rise from a flattened condition below support surface 20 to a position generally adjacent the top of the bottom support surface 20 when the bag is completely opened and filled with air.

Although the present invention has been described with preferred embodiments, it is to be understood that modifications and variations may be resorted to, without departing from the spirit and scope of this invention, as those skilled in the art will readily understand. Such variations and modifications are considered to be within the purview and scope of the appended claims.

What is claimed is:

1. An apparatus to facilitate the bagging of articles comprising a check-out counter having a section with a flat top where articles are placed, a bag stack comprising a plurality of open mouth thermoplastic bags each of said bags having integral handles on opposite sides of the open mouth portion of said bags, said bag being suspended from a location adjacent to and below the top of said counter; a pneumatic device comprising a blower and air plenum chamber provided with an air outlet above and adjacent said open mouth portion of said bags to provide a steady stream of air into the mouth of the outermost of said bags, to open said bag and to maintain said bag in an open position while it is being loaded with said articles; said individual loaded bag being removed from said bag pack by grasping said handles of said loaded bag and positioning said loaded bag at a point removed from said section; said apparatus being further characterized by having a bag support surface which is located adjacent to and slightly above the bottom of said bag stack whereby when individual bags are inflated thereby causing the individual bag bottom to rise slightly when said bag is in an inflated condition said bag bottom will be supported on the said support surface.

* * * * *